US008528667B2

(12) United States Patent
Bouaphanh

(10) Patent No.: US 8,528,667 B2
(45) **Date of Patent: *Sep. 10, 2013**

(54) WEAR RESISTANT MATERIAL AT THE LEADING EDGE OF THE LEG FOR A ROTARY CONE DRILL BIT

(75) Inventor: Inpeng Bouaphanh, Carrollton, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 23 days.

This patent is subject to a terminal disclaimer.

(21) Appl. No.: 13/156,458

(22) Filed: Jun. 9, 2011

(65) Prior Publication Data

US 2012/0080238 A1 Apr. 5, 2012

Related U.S. Application Data

(63) Continuation-in-part of application No. 12/896,406, filed on Oct. 1, 2010.

(51) Int. Cl.
*E21B 10/14* (2006.01)

(52) U.S. Cl.
USPC ..... 175/374; 175/432

(58) Field of Classification Search
USPC ..... 175/374, 336, 435, 432
See application file for complete search history.

(56) References Cited

U.S. PATENT DOCUMENTS 3,389,761 A 6/1968 Ott
3,461,983 A * 8/1969 Hudson et al. ..... 175/375
4,421,184 A 12/1983 Mullins
4,531,595 A 7/1985 Housman
4,591,008 A * 5/1986 Oliver ..... 175/227
5,074,367 A * 12/1991 Estes ..... 175/374
5,145,016 A * 9/1992 Estes ..... 175/331
5,289,889 A * 3/1994 Gearhart et al. ..... 175/325.5
5,415,243 A 5/1995 Lyon et al.
5,494,123 A 2/1996 Nguyen
5,570,750 A 11/1996 Williams
5,644,956 A 7/1997 Blackman et al.
5,709,278 A 1/1998 Crawford
5,975,223 A * 11/1999 Karlsson ..... 175/374
6,116,357 A 9/2000 Wagoner et al.
6,296,067 B1 * 10/2001 Slaughter et al. ..... 175/228
6,336,512 B1 1/2002 Siracki et al.
6,446,739 B1 9/2002 Richman et al.
6,450,270 B1 9/2002 Saxton
6,575,350 B2 * 6/2003 Evans et al. ..... 228/122.1

(Continued)

OTHER PUBLICATIONS

International Search Report and Written Opinion for PCT/US2011/054132 mailed Mar. 26, 2012 (8 pages).

*Primary Examiner* — Daniel P Stephenson
(74) *Attorney, Agent, or Firm* — Gardere Wynne Sewell LLP; Andre M. Szuwalski

(57) ABSTRACT

A rotary cone drill bit includes: a body, a leg depending from the body, a bearing shaft extending from the leg and a cone mounted to the bearing shaft. The leg includes a leading edge (at an outer surface or shoulder surface, for example) that is subject to wear during operation of the bit. A bottom surface of a hard material plate having an edge is attached to a conforming surface of the leg in a position where the edge of the hard material plate defines at least a portion of the leading edge of the leg. The attachment of the surfaces is made using a flowable material such as a brazing material.

31 Claims, 7 Drawing Sheets

(56) References Cited

U.S. PATENT DOCUMENTS

| | | | | |
|---|---|---|---|---|
| 6,607,047 | B1 | 8/2003 | Swadi et al. | |
| 6,619,412 | B2 | 9/2003 | Slaughter, Jr. et al. | |
| 6,688,410 | B1 * | 2/2004 | Singh et al. | 175/374 |
| 6,955,233 | B2 | 10/2005 | Crowe et al. | |
| 7,350,600 | B2 | 4/2008 | Beuershausen et al. | |
| 7,621,347 | B2 | 11/2009 | Overstreet | |
| 8,096,373 | B2 * | 1/2012 | Patel et al. | 175/431 |
| 2002/0035895 | A1 * | 3/2002 | Davies et al. | 76/108.2 |
| 2004/0173384 | A1 * | 9/2004 | Yong et al. | 175/374 |
| 2006/0213692 | A1 * | 9/2006 | Singh et al. | 175/339 |
| 2007/0163812 | A1 | 7/2007 | Overstreet et al. | |
| 2008/0202817 | A1 | 8/2008 | Massey et al. | |
| 2009/0032572 | A1 * | 2/2009 | Oxfdord et al. | 228/198 |
| 2009/0038442 | A1 | 2/2009 | Shamburger et al. | |
| 2010/0071961 | A1 | 3/2010 | Steel et al. | |
| 2010/0101866 | A1 | 4/2010 | Bird | |
| 2010/0224418 | A1 * | 9/2010 | Eason et al. | 175/340 |
| 2012/0080236 | A1 * | 4/2012 | Bouaphanh | 175/374 |
| 2012/0080237 | A1 * | 4/2012 | Bouaphanh | 175/374 |
| 2012/0080238 | A1 * | 4/2012 | Bouaphanh | 175/374 |

* cited by examiner

WEAR RESISTANT MATERIAL AT THE LEADING EDGE OF THE LEG FOR A ROTARY CONE DRILL BIT

CROSS-REFERENCE TO RELATED APPLICATION

The present application is a continuation-in-part application from co-pending U.S. application patent Ser. No. 12/896,406 filed Oct. 1, 2010 entitled "Wear Resistant Material at the Shirttail Edge and Leading Edge of a Rotary Cone Drill Bit", the disclosure of which is hereby incorporated by reference to the maximum extent allowable by law.

BACKGROUND

1. Technical Field of the Invention

The present invention relates to earth boring bits, and more particularly to those having rotatable cutters, also known as rotary cone drill bits.

2. Description of Related Art

Reference is made to FIGS. 1 and 2, wherein FIG. 1 illustrates an isometric view of a prior art rotary cone drill bit 10 and FIG. 2 illustrates a cross-sectional view of a portion of the prior art rotary cone drill bit 10 of FIG. 1. A leg 12 depends from a body portion 14 of the drill bit 10. The leg 12 includes a bearing shaft 16 which extends in a downward and radial inward direction. The bearing shaft 16 includes a cylindrical bearing surface 18. A cutter cone 20 is mounted to the bearing shaft 16 and supported for rotation by the bearing surface 18. In an alternative implementation, the cutter cone 20 is supported for rotation on the bearing shaft 16 by a set of roller bearings. The shape and configuration of the cone 20, as well its rotatable attachment to the bearing shaft 16, is well known in the art. In sealed bearing implementations, the bearing (journal or roller) between the cone 20 and bearing shaft 16 is lubricated by a lubricant (such as a grease) that fills regions adjacent to the bearing as well as other passages 21 in the rotary cone drill bit in a manner well known by those skilled in the art. This lubricant is retained within the rotary cone drill bit through the use of, for example, a resilient seal in the form of an o-ring 22 positioned in a seal gland 24 between the inner cylindrical surface 26 near the base of the cone 20 and the outer cylindrical surface 28 near the base of the bearing shaft 16. The lubrication system further includes a pressure compensation assembly 27 installed within an opening 29 formed in an upper shoulder surface 25 of the leg 12. The opening 29 is coupled to the passage 21. FIGS. 1 and 2 illustrate an implementation wherein the opening 29 is formed exclusively in the shoulder surface 25. It will be understood, however, that the opening 29 may be formed partially in the shoulder surface 25 and partially in the outer (gage or shirttail) surface 30 of the leg 12 (below shoulder surface 25). Still further, the opening 29 may be formed in the outer surface 30 of the leg.

The outer surface 30 of the leg 12 terminates at a semicircular edge 32 proximal to the cone 20. The region of the leg 12 associated with the surface 30 is known in the art as the "shirttail region," and the edge 32 is known in the art as the "shirttail edge." The shirttail edge 32 is provided where the terminal portion of the outer gage or shirttail surface 30 transitions to an inside radial surface 34 oriented parallel to the base of the cone 20 (and perpendicular to the bearing shaft 16) and positioned at the base of the bearing shaft 16.

The outer surface 30 of the leg 12 (below shoulder surface 25) in the shirttail region laterally terminates at a leading shirttail edge 50 and a trailing shirttail edge 52. The leading shirttail edge 50 is especially susceptible to wear during operation of the rotary cone drill bit 10. The prior art teaches two methods for delaying wear of the leading shirttail edge 50. FIG. 3 illustrates a first method in which a layer of welded hardfacing material 40 is applied to the surface 30 extending along at least a portion of the leading shirttail edge 50. The hardfacing material is typically a deposit of tungsten carbide hardmetal 40. The material is typically pelletized tungsten carbide carried in a nickel welding medium. This solution does not work well when the rotary cone drill bit is run in a highly abrasive rock formation because the hardfacing material 40 wears down too quickly. It is primarily the welding medium, typically nickel, which accounts for the relative poor performance of the weld on material. FIG. 4 illustrates a second method in which tungsten carbide inserts 42 are press-fit into holes 44 formed in the surface 30 near the leading shirttail edge 50. While these inserts 42 provide better abrasion resistance (in comparison to the use of hardfacing material), the inserts 42 do not provide protection for the leading shirttail edge 50. The reason for this is that the holes 44 must be located at some appreciable distance from the leading shirttail edge 50 in order for the press-fit to function properly and peripherally retain the inserts 42. For example, a separation d2 of at least 0.125 inches is typically provided from the edge of the hole 44 to the leading edge 50. Thus, the method of FIG. 4 functions to primarily protect the shirttail region near to, but not exactly at, the leading shirttail edge 50. Furthermore, in order to be suitably retained, the press-fit inserts 42 must typically have a thickness t (with a corresponding depth of the hole 44) such that a ratio of the thickness of the insert to a diameter d' of the insert (where the inserts are round) or width w of the insert (with other shapes) exceeds about 0.5 (i.e., $t/d' \geqq 0.5$; or $t/w \geqq 0.5$).

Although not explicitly shown in FIGS. 3 and 4, the protection mechanisms shown could alternatively, or additionally, be provided on the leading side surface 54 of the leg 12. This leading side surface 54 is adjacent the outer surface 30 of the leg 12 at the leading shirttail edge 50.

With reference once again to FIGS. 1 and 2, the shoulder surface 25 of the leg 12 laterally terminates at a leading shoulder edge 51 and a trailing shoulder edge 53. The leading shoulder edge 51 is also susceptible to wear during operation of the rotary cone drill bit 10, more specifically when the bit 10 is being removed from the drill hole. This is because the shoulder edge 51 may have to function in a cutting-like or abrasive manner to remove formation materials in instances where the drilled hole has narrowed. The leading shoulder edge 51 and shoulder surface 25 are further susceptible to damage from formation material falling in the drill hole and having to be removed. Wear of the leading shoulder edge 51 and shoulder surface 25 can have adverse affects on the opening 29 and the pressure compensation assembly 27 installed within that opening 29 that perhaps lead to premature failure of the lubrication system.

A need thus exists in the art to provide an improved method of protecting the leading shirttail edge 50 and leading shoulder edge 51, as well as the leading side surface 54, of the leg.

SUMMARY

In an embodiment, a rotary cone drill bit comprises: a body, a leg depending from the body, a bearing shaft extending from the leg and a cone mounted to the bearing shaft. The leg includes a lateral leading edge. The lateral leading edge may be associated with either (or both) an outer surface of the leg or a shoulder surface of the leg (above the outer surface). A bottom surface of a hard material plate having an edge is attached to a substantially conforming surface of the leg in a position where the edge of the hard material plate defines at least a portion of the lateral leading edge of the leg.

In an embodiment, a rotary cone drill bit comprises: a body, a leg depending from the body, a bearing shaft extending from the leg and a cone mounted to the bearing shaft. The leg includes a surface edge that is subject to wear during operation of the bit. The surface edge may be associated with either (or both) an outer surface of the leg or a shoulder surface of the leg (above the outer surface). A bottom surface of a hard material plate having an edge is attached to a substantially conforming surface of the leg in a position where the edge of the hard material plate defines at least a portion of the surface edge of the leg.

In any of the foregoing embodiments, the conforming surface to which attachment is made may comprise: a floor surface formed in or by an outer surface of the leg, a floor surface formed in or by a shoulder surface of the leg, a floor surface formed in or by a leading side surface of the leg (adjacent either the outer surface or shoulder surface), a floor surface of a slot formed in the outer surface of the leg, a floor surface of a slot formed in the shoulder surface of the leg, or a floor surface of a slot formed in the leading side surface of the leg (adjacent either the outer surface or shoulder surface).

In any of the foregoing embodiments, a material for attaching the hard material plate may comprise a flowable adhesive material interposed between the bottom surface of the hard material plate to the floor surface of the leg. That material may comprise, for example, a brazing material.

In any of the foregoing embodiments, the hard material plate may comprise polycrystalline diamond compact, or be made of a material such as solid tungsten carbide, or comprise a polycrystalline cubic boron nitride compact, or comprise an impregnated diamond segment.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

Figure 1:
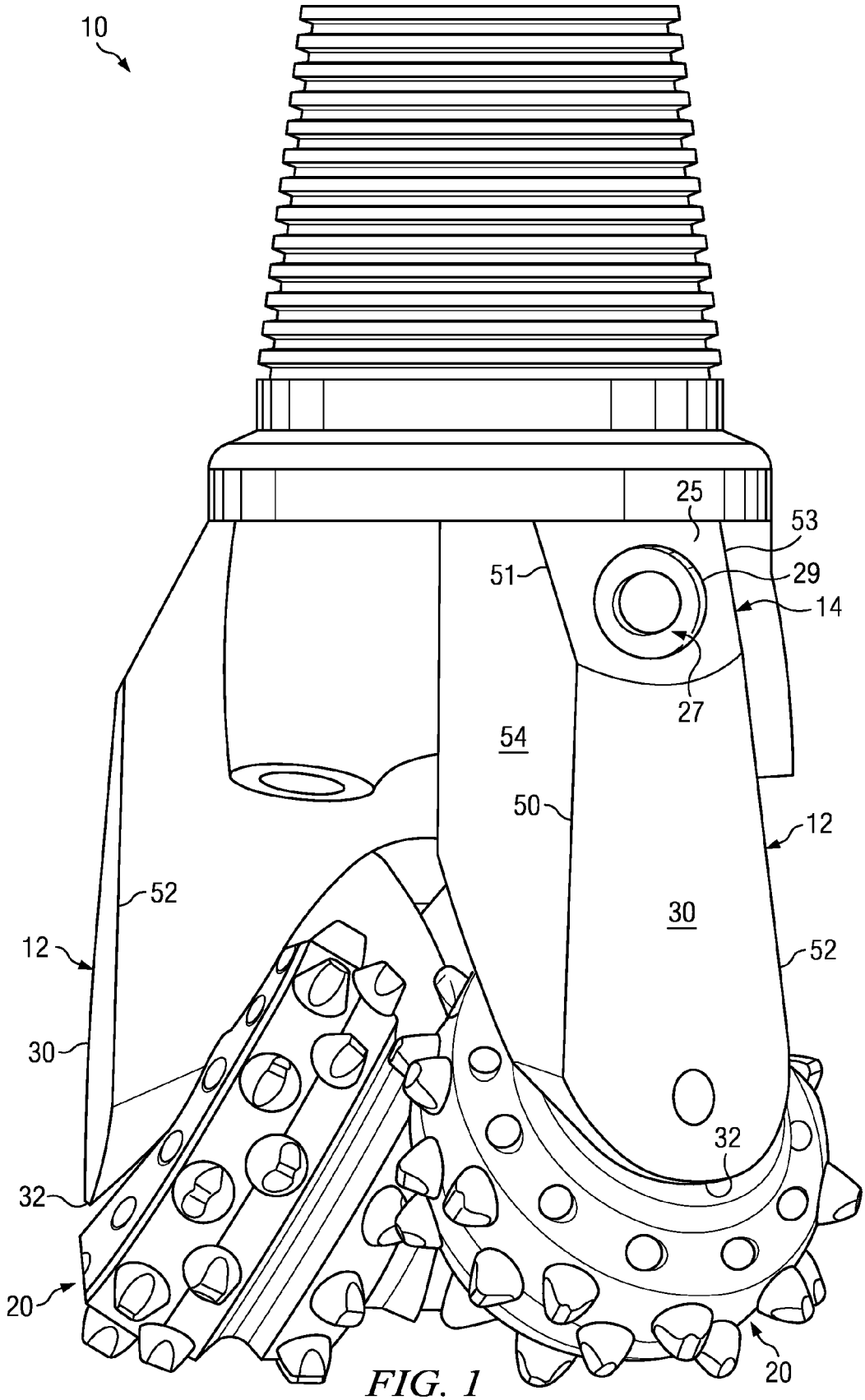
FIG. 1 (PRIOR ART)
FIG. 1 illustrates an isometric view of a prior art rotary cone drill bit.
Figure 2:
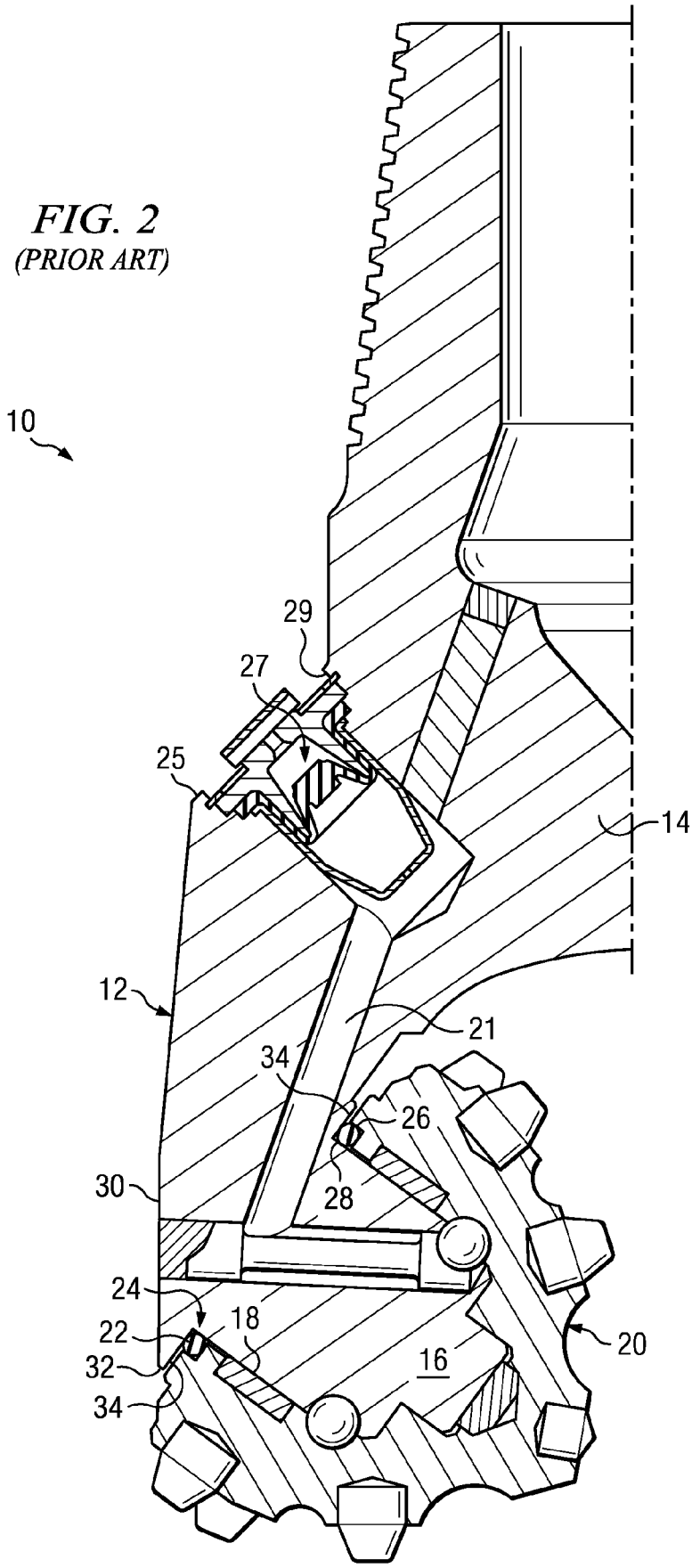
FIG. 2 (PRIOR ART)
FIG. 2 illustrates a cross-sectional view of a portion of a leg of the prior art rotary cone drill bit of FIG. 1.
Figure 3:
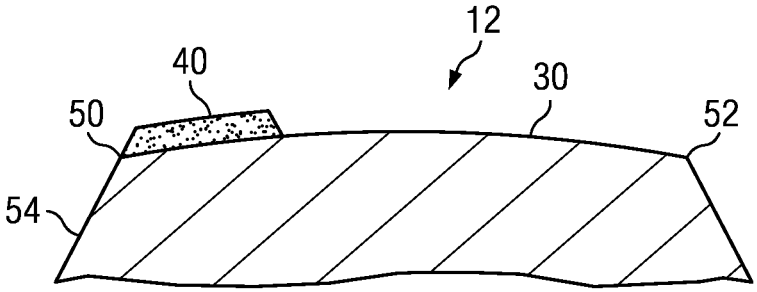
FIG. 3 (PRIOR ART)
FIG. 3 illustrates application of a layer of hardfacing material extending along at least a portion of the leading edge of the leg.
Figure 5:
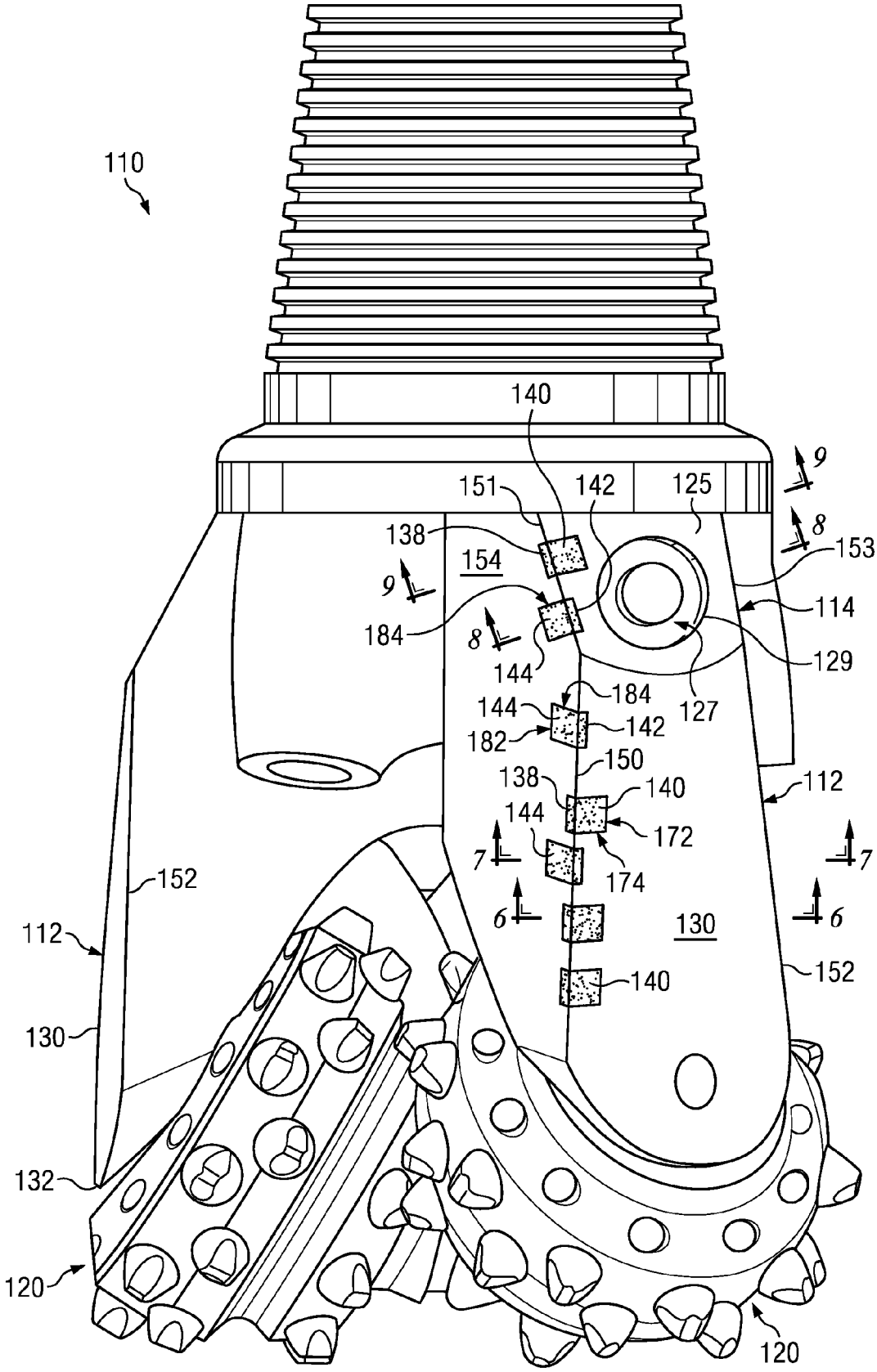
FIG. 5 illustrates an isometric view of a rotary cone drill bit including protection mechanisms for the leading edges of the leg at the shirttail and shoulder.

Reference is now made to FIG. 5 which illustrates an isometric view of a rotary cone drill bit 110 including protection mechanisms for the leading edge (also referred to as the lateral leading edge) of the leg. A leg 112 depends from a body portion 114 of the drill bit 110. The leg 112 includes a bearing shaft (not shown, see FIG. 2 reference 16) which extends in a downward and radial inward direction. A cutter cone 120 is mounted to the bearing shaft and supported thereon for rotation. The outer gage or shirttail surface 130 of the leg 112 (located at the gage of the bit) terminates at a semicircular edge 132 proximal to the cone 120. The region of the leg 112 associated with the surface 130 is known in the art as the "shirttail region," and the edge 132 is known in the art as the "shirttail edge." The outer gage or shirttail surface 130 of the leg 112 laterally terminates at a leading shirttail edge 150 and a trailing shirttail edge 152. The lateral leading edge 150 and lateral trailing edge 152 of the shirttail comprise extensions of the shirttail edge 132 extending along the length of the leg 112. The leg 112 further includes a shoulder surface 125 (positioned above the outer surface 130 and angled inwardly from the outer surface 130). The shoulder surface 125 of the leg 112 laterally terminates at a leading shoulder edge 151 and a trailing shoulder edge 153. The lateral leading edge 151 and lateral trailing edge 153 of the shoulder comprise extensions of the shirttail edges 150 and 152, respectively, extending along the length of the leg 112 (and may be referred to as the lateral leading edge of the leg 112). The leg further includes a leading side surface 154 which is adjacent the outer surface 130 and shoulder surface 125 of the leg 112 at the leading shirttail edge 150 and leading shoulder edge 151.

The illustrated drill bit utilizes a sealed bearing system. The lubrication system includes a pressure compensation assembly 127 installed within an opening 129 formed in the upper shoulder surface 125 of the leg 112. FIG. 5 illustrates an implementation wherein the opening 129 is formed exclusively in the shoulder surface 125. It will be understood, however, that the opening 129 may be formed partially in the shoulder surface 125 and partially in the outer surface 130 of the leg 112 (below shoulder surface 125). Alternatively, the opening 129 may be formed exclusively in the outer surface 130.

To protect the lateral leading edge 150 and surface 130 of the leg, a slot 138 is provided in the outer surface 130 of the leg 112 extending inwardly from the leading edge 150, and a hard plate insert 140 is adhered to a floor surface within the slot 138. See, also, FIG. 6. To protect the lateral leading edge 150 and the leading side surface 154, a slot 142 is provided in the leading side surface 154 of the leg 112 extending outwardly from the leading edge 150 of the shirttail, and a hard plate insert 144 is adhered to a floor surface within the slot 142. See, also, FIG. 7. To protect the shoulder leading edge 151 and the leading side surface 154, a slot 142 is provided in the leading side surface 154 of the leg 112 extending outwardly from the shoulder leading edge 151, and a hard plate insert 144 is adhered to a floor surface within the slot 142. See, also, FIG. 8. To protect the shoulder leading edge 151 and the shoulder surface 125, a slot 138 is provided in the shoulder surface 125 of the leg 112 extending inwardly from the leading edge 151, and a hard plate insert 140 is adhered to a floor surface within the slot 138. See, also, FIG. 9. Such an installation on the surface 125, in some instances, may be impractical because of the size and positioning of the opening 129. The slots may be milled or cast into the outer surface 130, shoulder surface 125 and/or leading side surface 154 of the leg 112 at desired positions, specifically positions on the leg which are susceptible to wear during operation of the bit, and may have flat or curved floor surface geometries as desired and which conform with the bottom surfaces of the inserts 140 and 144.

Although multiple protection mechanisms are illustrated in FIG. 5, it will be understood that any one or more of the illustrated protection mechanisms may be selected for use on the rotary cone drill bit 110. Although FIG. 5 illustrates the use of several hard plate inserts 140 along the leading edge 150, it will be understood that one slot 138 could instead be provided extending along all or a portion of the leading edge 150, with a single hard plate insert 140 adhered within the slot 138. Although FIG. 5 illustrates the use of several hard plate inserts 144 along the leading edge 150, it will be understood that one slot 142 could instead be provided extending along all or a portion of the leading edge 150, with a single hard plate insert 144 adhered within the slot 142. Although FIG. 5 illustrates the use of a single hard plate insert 144 along the shoulder leading edge 151, it will be understood that multiple slots with multiple inserts could be provided and further that one slot 142 could be provided extending along all or a portion of the shoulder leading edge 151, with a single hard plate insert 144 adhered within the slot 142. Although FIG. 5 illustrates the use of a single hard plate insert 140 along the shoulder leading edge 151, it will be understood that multiple slots with multiple inserts could be provided and further that one slot 138 could be provided extending along all or a portion of the shoulder leading edge 151, with a single hard plate insert 140 adhered within the slot 138. In each of the foregoing implementations, the portion of the edge (leading shirttail edge 150 and/or shoulder leading edge 151) selected to receive protection would be that portion of the edge which is most susceptible to wear during operation of the rotary cone drill bit 110.

Although FIG. 5 primarily illustrates the use of polygonal plate inserts, it will be understood that the plate inserts can have any desired shape (including circular shapes, oval shapes, semi-circular shapes, and the like). Furthermore, the plate inserts can be of different sizes, perhaps with size selection depending on placement position.

Figure 6:
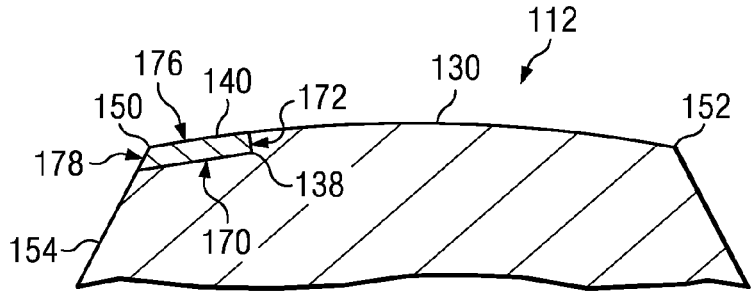
FIGS. 6, 7, 8 and 9 illustrate cross-sectional views of a portion of a leg of a rotary cone drill bit which include embodiments of a mechanism for protecting the leading edge of the leg at the shirttail and shoulder.

Reference is now made to FIG. 6 which illustrates a cross-sectional view of a portion of a leg of a rotary cone drill bit which includes an embodiment of a protection mechanism for the lateral leading edge of the leg. In this embodiment, the slot 138 is provided in the outer surface 130 of the leg 112 extending inwardly from the lateral leading edge 150. The slot 138 may be milled or cast into the outer surface 130 of the leg 112. The slot 138 is defined by a floor surface 170, a rear wall 172 and two side walls 174 (see, also, FIG. 5). The hard plate insert 140 is adhered within the slot 138. In a preferred embodiment, a bottom surface of hard plate insert is adhered to the floor surface 170 of the slot 138. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 6, but it will be understood that the adhesive material is present between the bottom surface and the floor surface. The adhesive material preferably has a substantially uniform thickness between the conforming bottom surface and floor surface. The hard plate insert 140 has a thickness such that when adhered within the slot 138, a top surface 176 of the plate insert 140 is substantially flush with, or slightly exposed beyond, or slightly recessed below, the outer surface 130 of the leg 112. Furthermore, the hard plate insert 140 is sized such that an edge 178 of the plate insert opposite the rear wall 172 of the slot 138 defines (or is coincident with or nearly coincident with) the leading edge 150 (leading surface 154) of the shirttail. The hard plate insert 140 is made of a material or combination of materials which are more abrasion resistant than the material used to make the leg and shirttail of the bit. In a preferred implementation, the hard plate insert is made of a material such as tungsten carbide, polycrystalline diamond compact (PDC), polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear.

Figure 4:
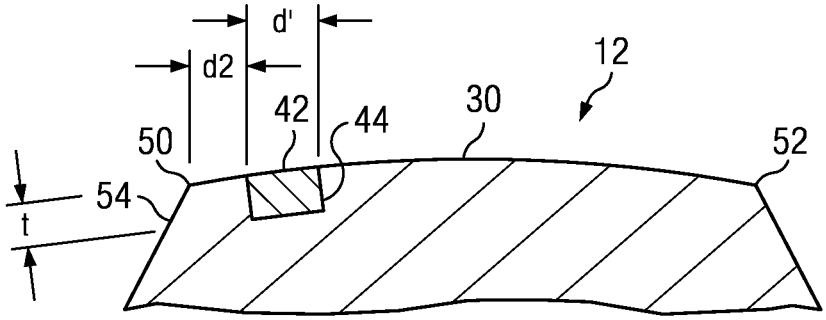
FIG. 4 (PRIOR ART)
FIG. 4 illustrates the use of tungsten carbide inserts near the leading edge of the leg.

The hard plate inserts 140 have a thickness t and width w (wherein the width is measured in a direction perpendicular to the leading edge 150). The hard plate inserts 140 are thin inserts. In this case, a ratio of the thickness t of the insert to a width w of the insert is less than 0.5 (i.e., $t/w<0.5$). More particularly, the ratio of the thickness t of the insert to the width w of the insert is substantially less than 0.5 (i.e., $t/w<<0.5$). Even more particularly, the ratio of the thickness t of the insert to the width w of the insert is less than 0.2 (i.e., $t/w<0.2$), and may even be less than 0.1 (i.e., $t/w<0.1$). This is permitted because the hard plate inserts 140 are retained by adhesion to their bottom surface and not their peripheral edge (as is the case with the press-fit inserts used in the prior art (see, FIG. 4).

Figure 7:
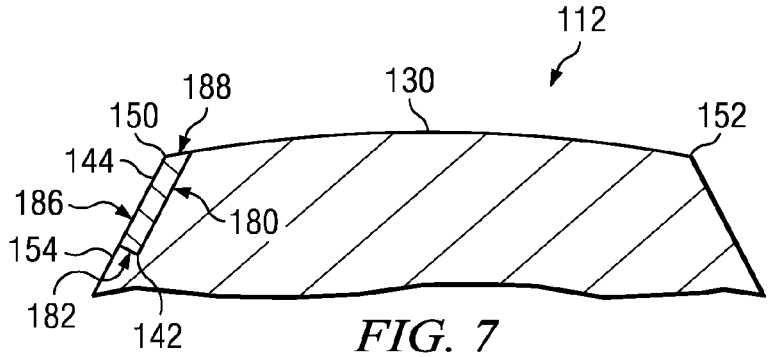

Reference is now made to FIG. 7 which illustrates a cross-sectional view of a portion of a leg of a rotary cone drill bit which includes an embodiment of a protection mechanism for the lateral leading edge of the leg. In this embodiment, the slot 142 is provided in the leading side surface 154 of the leg 112 extending outwardly from the lateral leading edge 150. The slot 142 may be milled or cast into the leading side surface 154 of the leg 112. The slot 142 is defined by a floor surface 180, a rear wall 182 and two side walls 184 (see, also, FIG. 5). The hard plate insert 144 is adhered within the slot 142. In a preferred embodiment, a bottom surface of hard plate insert is adhered to the floor surface 180 of the slot 142. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). The adhesive material preferably has a substantially uniform thickness between the conforming bottom surface and floor surface. Because of drawing scale, the adhesive material is not explicitly shown in FIG. 7, but it will be understood that the adhesive material is present between the bottom surface and the floor surface. The hard plate insert 144 has a thickness such that when adhered within the slot 142, a top surface 186 of the plate insert 144 is substantially flush with, or slightly exposed beyond, or slightly recessed below, the leading side surface 154 of the leg 112. Furthermore, the hard plate insert 144 is sized such that edge 188 of the plate insert opposite the rear wall 172 of the slot 138 defines (or is coincident with or nearly coincident with) the leading edge 150 (outer surface 130). The hard plate insert 140 is made of a material or combination of materials which are more abrasion resistant than the material used to make the leg and shirttail of the bit. In a preferred implementation, the hard plate insert is made of a material such as tungsten carbide, polycrystalline diamond compact (PDC), polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear.

The hard plate inserts 144 have a thickness t and width w (wherein the width is measured in a direction perpendicular to the leading edge 150). The hard plate inserts 144 are thin inserts. In this case, a ratio of the thickness t of the insert to a width w of the insert to is less than 0.5 (i.e., $t/w<0.5$). More particularly, the ratio of the thickness t of the insert to the width w of the insert is substantially less than 0.5 (i.e., $t/w<<0.5$). Even more particularly, the ratio of the thickness t of the insert to the width w of the insert is less than 0.2 (i.e., $t/w<0.2$), and may even be less than 0.1 (i.e., $t/w<0.1$). This is permitted because the hard plate inserts 144 are retained by adhesion to their bottom surface and not their peripheral edge (as is the case with the press-fit inserts used in the prior art (see, FIG. 4).

Figure 8:
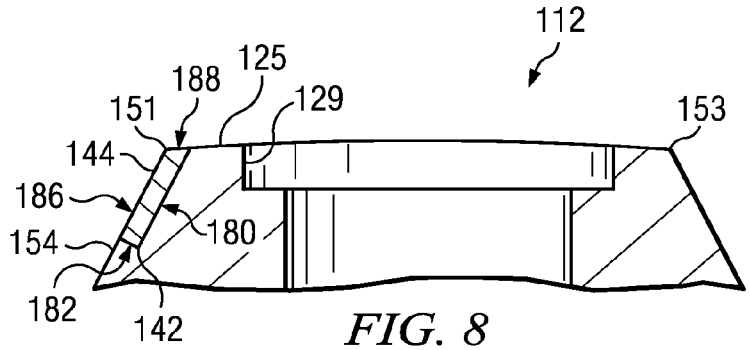

Reference is now made to FIG. 8 which illustrates a cross-sectional view of a portion of a leg of a rotary cone drill bit which includes an embodiment of a protection mechanism for the shoulder lateral leading edge 151. In this embodiment, the slot 142 is provided in the leading side surface 154 of the leg 112 extending outwardly from the shoulder lateral leading edge 151. The slot 142 may be milled or cast into the leading side surface 154 of the leg 112. The slot 142 is defined by a floor surface 180, a rear wall 182 and two side walls 184 (see, also, FIG. 5). The hard plate insert 144 is adhered within the slot 142. In a preferred embodiment, a bottom surface of hard plate insert is adhered to the floor surface 180 of the slot 142. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). The adhesive material preferably has a substantially uniform thickness between the conforming bottom surface and floor surface. Because of drawing scale, the adhesive material is not explicitly shown in FIG. 8, but it will be understood that the adhesive material is present between the bottom surface and the floor surface. The hard plate insert 144 has a thickness such that when adhered within the slot 142, a top surface 186 of the plate insert 144 is substantially flush with, or slightly exposed beyond, or slightly recessed below, the leading side surface 154 of the leg 112. Furthermore, the hard plate insert 144 is sized such that edge 188 of the plate insert opposite the rear wall 172 of the slot 138 defines (or is coincident with or nearly coincident with) the leading edge 151 (shoulder surface 125). The hard plate insert 140 is made of a material or combination of materials which are more abrasion resistant than the material used to make the leg and shirttail of the bit. In a preferred implementation, the hard plate insert is made of a material such as tungsten carbide, polycrystalline diamond compact (PDC), polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear.

The hard plate inserts 144 have a thickness t and width w (wherein the width is measured in a direction perpendicular to the leading edge 151). The hard plate inserts 144 are thin inserts. In this case, a ratio of the thickness t of the insert to a width w of the insert to is less than 0.5 (i.e., $t/w<0.5$). More particularly, the ratio of the thickness t of the insert to the width w of the insert is substantially less than 0.5 (i.e., $t/w<<0.5$). Even more particularly, the ratio of the thickness t of the insert to the width w of the insert is less than 0.2 (i.e., $t/w<0.2$), and may even be less than 0.1 (i.e., $t/w<0.1$). This is permitted because the hard plate inserts 144 are retained by adhesion to their bottom surface and not their peripheral edge (as is the case with the press-fit inserts used in the prior art (see, FIG. 4).

Figure 9:
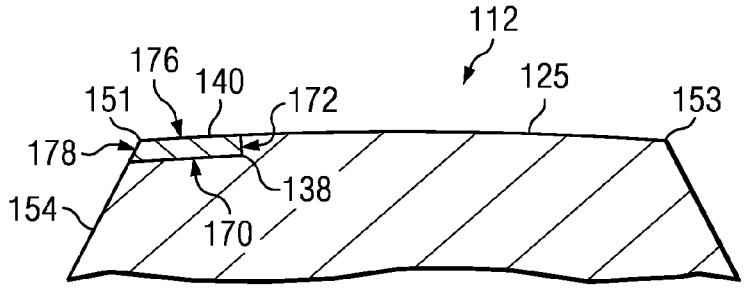

Reference is now made to FIG. 9 which illustrates a cross-sectional view of a portion of a leg of a rotary cone drill bit which includes an embodiment of a protection mechanism for the lateral leading edge of the leg. In this embodiment, the slot 138 is provided in the shoulder surface 125 of the leg 112 extending inwardly from the lateral leading edge 151. The slot 138 may be milled or cast into the shoulder surface 125 of the leg 112. The slot 138 is defined by a floor surface 170, a rear wall 172 and two side walls 174 (see, also, FIG. 5). The hard plate insert 140 is adhered within the slot 138. In a preferred embodiment, a bottom surface of hard plate insert is adhered to the floor surface 170 of the slot 138. The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 9, but it will be understood that the adhesive material is present between the bottom surface and the floor surface. The adhesive material preferably has a substantially uniform thickness between the conforming bottom surface and floor surface. The hard plate insert 140 has a thickness such that when adhered within the slot 138, a top surface 176 of the plate insert 140 is substantially flush with, or slightly exposed beyond, or slightly recessed below, the shoulder surface 125 of the leg 112. Furthermore, the hard plate insert 140 is sized such that an edge 178 of the plate insert opposite the rear wall 172 of the slot 138 defines (or is coincident with or nearly coincident with) the leading edge 151 (leading surface 154) of the shirttail. The hard plate insert 140 is made of a material or combination of materials which are more abrasion resistant than the material used to make the leg and shirttail of the bit. In a preferred implementation, the hard plate insert is made of a material such as tungsten carbide, polycrystalline diamond compact (PDC), polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear.

The hard plate inserts 140 have a thickness t and width w (wherein the width is measured in a direction perpendicular to the leading edge 151). The hard plate inserts 140 are thin inserts. In this case, a ratio of the thickness t of the insert to a width w of the insert is less than 0.5 (i.e., t/w<0.5). More particularly, the ratio of the thickness t of the insert to the width w of the insert is substantially less than 0.5 (i.e., t/w<<0.5). Even more particularly, the ratio of the thickness t of the insert to the width w of the insert is less than 0.2 (i.e., t/w<0.2), and may even be less than 0.1 (i.e., t/w<0.1). This is permitted because the hard plate inserts 140 are retained by adhesion to their bottom surface and not their peripheral edge (as is the case with the press-fit inserts used in the prior art (see, FIG. 4).

It will be noted that the slots and plate inserts may be of any selected geometry thus allowing for the application of protection to complex surfaces of the bit. Tiling of the inserts edge-to-edge permits the application of protection to be extended continuously over a complex curved surface. Alternatively, a single insert with a complex curved bottom surface could be provided.

The illustration of protection being applied using slots and plate inserts at the leading shirttail edge and/or shoulder leading edge is by way of example only, it being understood that the protection mechanisms described can be applied to any edges of the bit that are susceptible to wear (including the shirttail edge and any trailing edges of the leg).

Figure 10:
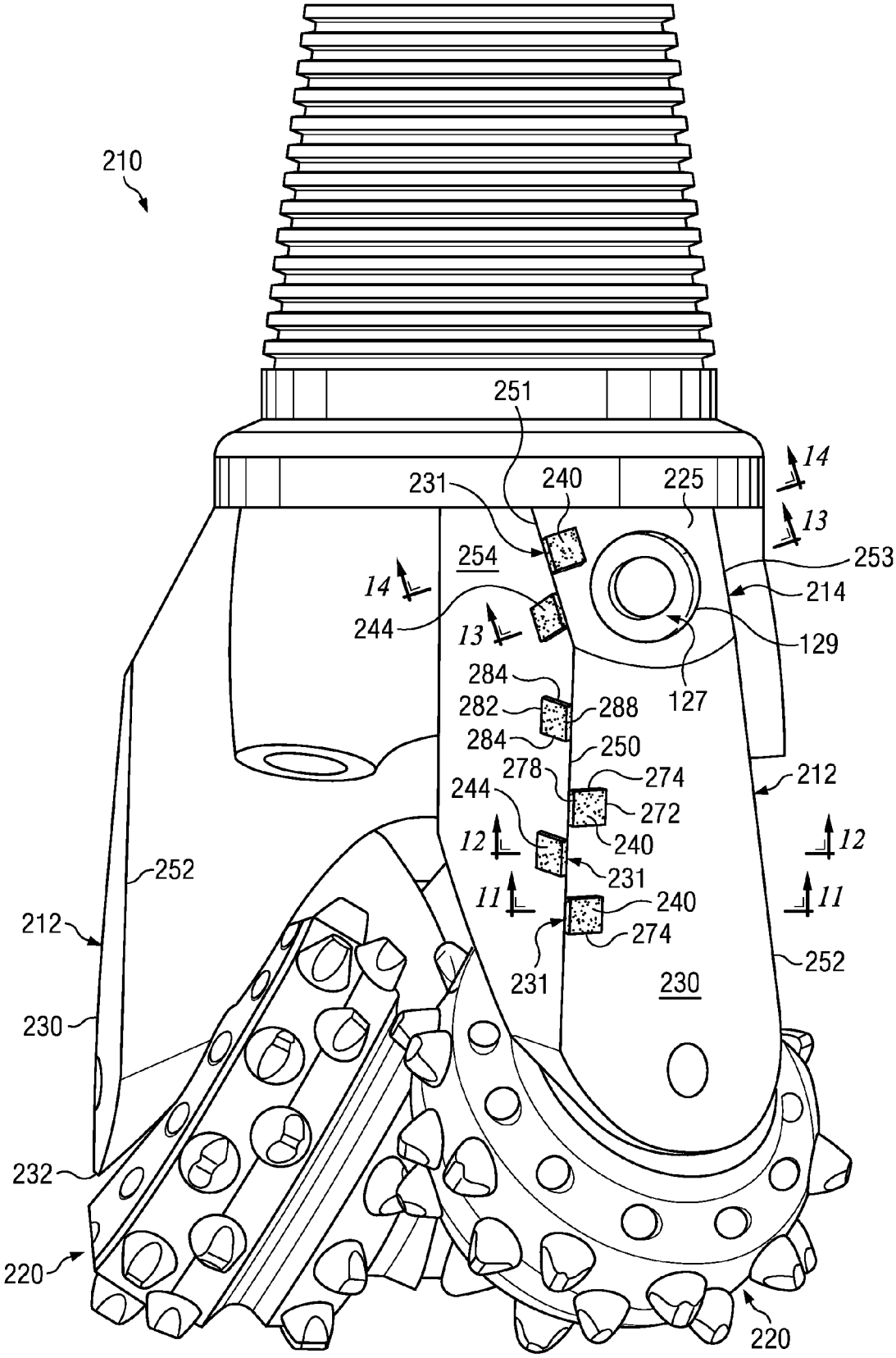
FIG. 10 illustrates an isometric view of a rotary cone drill bit including protection mechanisms for the leading edges of the leg at the shirttail and shoulder.

Reference is now made to FIG. 10 which illustrates an isometric view of a rotary cone drill bit 210 including protection mechanisms for the leading edges of the leg. A leg 212 depends from a body portion 214 of the drill bit 210. The leg 212 includes a bearing shaft (not shown, see FIG. 2 reference 16) which extends in a downward and radial inward direction. A cutter cone 220 is mounted to the bearing shaft and supported thereon for rotation. The outer gage or shirttail surface 230 of the leg 212 (located at the gage of the bit) terminates at a semicircular edge 232 proximal to the cone 220. The region of the leg 212 associated with the outer gage or shirttail surface 230 is known in the art as the "shirttail region," and the edge 232 is known in the art as the "shirttail edge." The outer surface 230 of the leg 212 laterally terminates at a leading shirttail edge 250 and a trailing shirttail edge 252. The leading edge 250 and a trailing edge 252 of the shirttail comprise extensions of the shirttail edge 232 extending along the length of the leg 212. The leg 212 further includes a shoulder surface 225 (above the outer surface 230). The shoulder surface 225 of the leg 212 laterally terminates at a leading shoulder edge 251 and a trailing shoulder edge 253. The lateral leading edge 251 and lateral trailing edge 253 of the shoulder comprise extensions of the shirttail edges 250 and 252, respectively, extending along the length of the leg 212 (and may be referred to as the lateral leading edge of the leg 212). The leg further includes a leading side surface 254 which is adjacent the outer surface 230 and shoulder surface 225 of the leg 212 at the leading shirttail edge 250 and leading shoulder edge 251.

The illustrated drill bit utilizes a sealed bearing system. The lubrication system includes a pressure compensation assembly 127 installed within an opening 129 formed in the upper shoulder surface 225 of the leg 212. FIG. 9 illustrates an implementation wherein the opening 129 is formed exclusively in the shoulder surface 225. It will be understood, however, that the opening 129 may be formed partially in the shoulder surface 225 and partially in the outer surface 230 of the leg 212 (below shoulder surface 225). Alternatively, the opening 129 may be formed exclusively in the outer surface 230.

To protect the leading edge 250 and outer surface 230 of the leg 212, a hard plate 240 is adhered to a floor surface 231 provided in or by the curved outer surface 230 of the leg 212 extending inwardly from the leading edge 250. See, also, FIG. 11. To protect the leading edge 250 and the leading side surface 254, a hard plate 244 is adhered to a floor surface 231 provided in or by the leading side surface 254 of the leg 212 extending outwardly from the leading edge 250. See, also, FIG. 12. To protect the shoulder leading edge 251 and the leading side surface 254, a hard plate 244 is adhered to a floor surface 231 provided in or by the leading side surface 254 of the leg 212 extending outwardly from the leading edge 251. See, also, FIG. 13. *To protect the leading edge 251 and shoulder surface 225 of the leg 212, a hard plate 240 is adhered to a floor surface 231 provided in or by the curved shoulder surface 225 of the leg 212 extending inwardly from the leading edge 251. See, also, FIG. 14. Such an installation on the shoulder surface 225, in many instances, may be impractical because of the size and positioning of the opening 129**.

Although multiple protection mechanisms are illustrated in FIG. 10, it will be understood that any one or more of the illustrated protection mechanisms may be selected for use on the rotary cone drill bit 210. The floor surfaces 231 are preferably machined or cast into the outer surfaces of the shirttail region along the edge 250 and edge 251, and may have flat or curved surface geometries as desired and which conform with the bottom surfaces of the plates 240 and 244.

Although FIG. 10 primarily illustrates the use of polygonal plates, it will be understood that the plates can have any desired shape (including circular shapes, oval shapes, semicircular shapes, and the like). Furthermore, the plates can be of different sizes, perhaps with size selection depending on placement position.

Although FIG. 10 illustrates the use of several hard plates 240 along the leading edge 250, it will be understood that one plate 240 could instead be provided extending along all or a portion of the leading edge 250. Although FIG. 10 illustrates the use of several hard plates 244 along the leading edge 250, it will be understood that one plate 244 could instead be provided extending along all or a portion of the leading edge 250. Although FIG. 10 illustrates the use of a single hard plate 244 along the leading edge 251, it will be understood that multiple plates 244 could instead be provided or that a single plate extending along all or a portion of the leading edge 251 could be used. Although FIG. 10 illustrates the use of a single hard plate 240 along the leading edge 251, it will be understood that multiple plates 240 could instead be provided or that a single plate extending along all or a portion of the leading edge 251 could be used. In each of the foregoing implementations, the portion of the edge (edge 250 and/or edge 251) selected to receive protection would be that portion of the edge which is most susceptible to wear during operation of the rotary cone drill bit 210.

Figure 11:
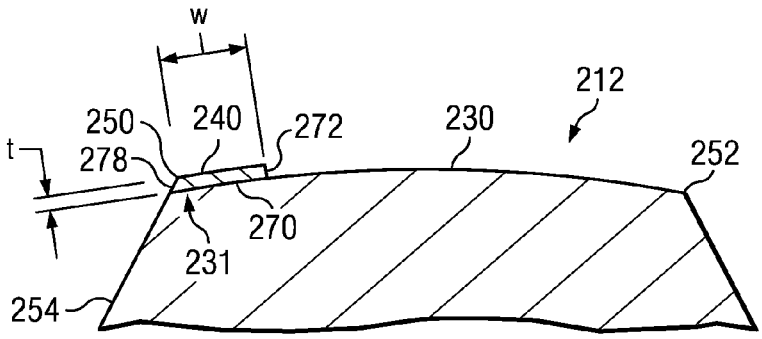
FIGS. 11, 12, 13 and 14 illustrate cross-sectional views of a portion of a leg of a rotary cone drill bit which include embodiments of a mechanism for protecting the leading edge of the leg at the shirttail and shoulder.

Reference is now made to FIG. 11 which illustrates a cross-sectional view of a portion of a leg of a rotary cone drill bit which includes an embodiment of a protection mechanism for the leading edge. In this embodiment, the bottom surface 270 of the hard plate 240 is adhered to a substantially conforming floor surface 231 formed in or by the outer surface 230 of the leg 212 and extending inwardly from the leading shirttail edge 250. The plate 240 is further defined by a rear edge 272 and two side edges 274 (see, also, FIG. 10). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 11, but it will be understood that the adhesive material is present between the bottom surface and the flattened surface. The adhesive material preferably has a substantially uniform thickness between the conforming bottom surface and floor surface. The hard plate 240 is sized such that its front edge 278 defines (or is coincident with, or is nearly coincident with) the leading edge 250 of the shirttail. The thickness of the plate 240 may range from 0.050 to 0.500 inches. The hard plate 240 is made of a material or combination of materials which are more abrasion resistant than the material used to make the leg and shirttail of the bit. In a preferred implementation, the hard plate is made of a material such as tungsten carbide, PDC, polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear. The conforming surfaces where adhesion takes place may curve, for example, with the radius of the bit, or have any selected curved configuration.

The hard plates 240 have a thickness t and width w (wherein the width is measured in a direction perpendicular to the leading edge 250). The hard plates 240 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

Figure 12:
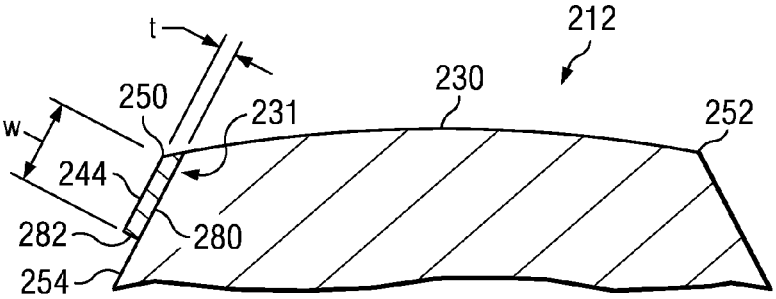

Reference is now made to FIG. 12 which illustrates a cross-sectional view of a portion of a leg of a rotary cone drill bit which includes an embodiment of a protection mechanism for the leading edge. In this embodiment, the bottom surface 280 of the hard plate 244 is adhered to a substantially conforming floor surface 231 formed in or by the leading surface 254 of the leg 212 and extending outwardly from the leading shirttail edge 250. The plate 244 is further defined by a rear edge 282 and two side edges 284 (see, also, FIG. 10). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 12, but it will be understood that the adhesive material is present between the bottom surface and the flattened surface on the leading side surface. The adhesive material preferably has a substantially uniform thickness between the conforming bottom surface and floor surface. The hard plate 244 is sized such that its front edge 288 defines (or is coincident with, or is nearly coincident with) the leading edge 250 of the shirttail. The thickness of the plate 244 may range from 0.050 to 0.500 inches. The hard plate 244 is made of a material or combination of materials which are more abrasion resistant than the material used to make the leg and shirttail of the bit. In a preferred implementation, the hard plate is made of a material such as tungsten carbide, PDC, polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear. The conforming surfaces where adhesion takes place may curve, for example, with the radius of the bit, or have any selected curved configuration.

The hard plates 244 have a thickness t and width w (wherein the width is measured in a direction perpendicular to the leading edge 250). The hard plates 244 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

Figure 13:
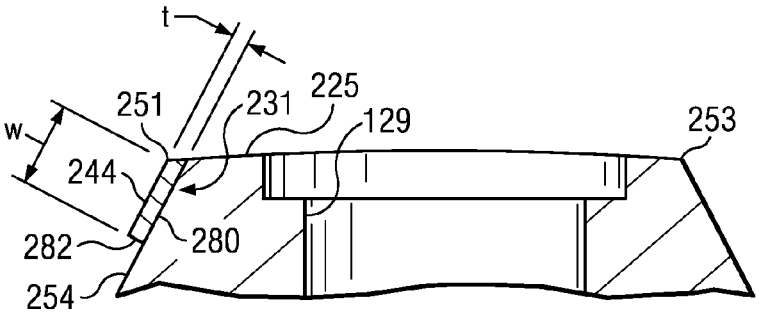

Reference is now made to FIG. 13 which illustrates a cross-sectional view of a portion of a leg of a rotary cone drill bit which includes an embodiment of a protection mechanism for the leading edge of the shoulder 225. In this embodiment, the bottom surface 280 of the hard plate 244 is adhered to a substantially conforming floor surface 231 formed in or by the leading surface 254 of the leg 212 and extending outwardly from the leading shoulder edge 251. The plate 244 is further defined by a rear edge 282 and two side edges 284 (see, also, FIG. 10). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 13, but it will be understood that the adhesive material is present between the bottom surface and the flattened surface on the leading side surface. The adhesive material preferably has a substantially uniform thickness between the conforming bottom surface and floor surface. The hard plate 244 is sized such that its front edge 288 defines (or is coincident with, or is nearly coincident with) the leading edge 251. The thickness of the plate 244 may range from 0.050 to 0.500 inches. The hard plate 244 is made of a material or combination of materials which are more abrasion resistant than the material used to make the leg and shirttail of the bit. In a preferred implementation, the hard plate is made of a material such as tungsten carbide, PDC, polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear. The conforming surfaces where adhesion takes place may curve, for example, with the radius of the bit, or have any selected curved configuration.

The hard plates 244 have a thickness t and width w (wherein the width is measured in a direction perpendicular to the leading edge 251). The hard plates 244 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

Figure 14:
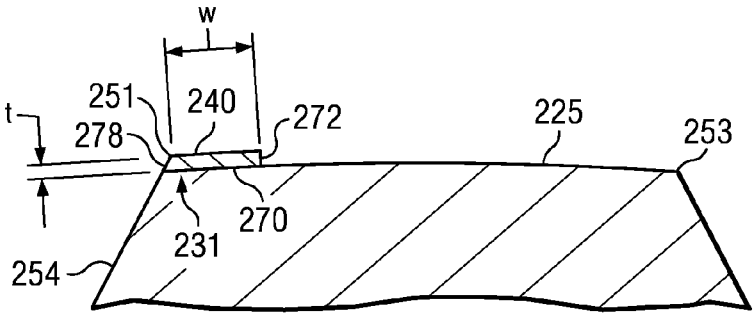

Reference is now made to FIG. 14 which illustrates a cross-sectional view of a portion of a leg of a rotary cone drill bit which includes an embodiment of a protection mechanism for the leading edge. In this embodiment, the bottom surface 270 of the hard plate 240 is adhered to a substantially conforming floor surface 231 formed in or by the shoulder surface 225 of the leg 212 and extending inwardly from the leading edge 251. The plate 240 is further defined by a rear edge 272 and two side edges 274 (see, also, FIG. 10). The means for adhering the bottom surface to the floor surface may, for example, comprise any suitable adhering material which is interposed between the substantially conforming (for example, parallel) surfaces including adhesive material flowable between the substantially conforming surfaces by capillary action such as a brazing material, solder, adhesives, resins, and the like (see, for example, U.S. Patent Application Publication No. 2009/0038442, the disclosure of which is hereby incorporated by reference). Because of drawing scale, the adhesive material is not explicitly shown in FIG. 14, but it will be understood that the adhesive material is present between the bottom surface and the flattened surface. The adhesive material preferably has a substantially uniform thickness between the conforming bottom surface and floor surface. The hard plate 240 is sized such that its front edge 278 defines (or is coincident with, or is nearly coincident with) the leading edge 251. The thickness of the plate 240 may range from 0.050 to 0.500 inches. The hard plate 240 is made of a material or combination of materials which are more abrasion resistant than the material used to make the leg and shirttail of the bit. In a preferred implementation, the hard plate is made of a material such as tungsten carbide, PDC, polycrystalline cubic boron nitride compact impregnated diamond segment, and the like. These materials are superior to the traditional weld on tungsten carbide hardfacing known in the prior art because they are denser and are not as susceptible to abrasion and erosion. Again, the adhesive material is this implementation is not externally exposed and subject to possible wear. The conforming surfaces where adhesion takes place may curve, for example, with the radius of the bit, or have any selected curved configuration.

The hard plates 240 have a thickness t and width w (wherein the width is measured in a direction perpendicular to the leading edge 251). The hard plates 240 are thin inserts. In this case, a ratio of the thickness t of the plate to a width w of the plate is less than 0.5 (i.e., $t/w<0.5$). More particularly, the ratio of the thickness t of the plate to the width w of the plate is substantially less than 0.5 (i.e., $t/w<<0.5$). Even more particularly, the ratio of the thickness t of the plate to the width w of the plate is less than 0.2 (i.e., $t/w<0.2$), and may even be less than 0.1 (i.e., $t/w<0.1$).

It will be noted that the hard plates may be of any selected geometry thus allowing for the application of protection to complex surfaces of the bit.

The illustration of protection being applied using plates at the leading shoulder edge and/or leading shirttail edge is by way of example only, it being understood that the protection mechanisms described can be applied to any edge of the bit that are susceptible to wear (including shirttail edges and trailing edges).

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A rotary cone drill bit, comprising:

a body;

a leg depending from the body, wherein the leg includes a leading edge;

a bearing shaft extending from the leg;

a cone mounted to the bearing shaft;

a preformed hard material plate having an edge and a bottom surface; and an adhesive material attaching the bottom surface of the hard material plate to a substantially conforming surface of the leg, wherein the edge of the hard material plate defines at least a portion of the leading edge.

2. The bit of claim 1 wherein the adhesive material attaching the bottom surface of the hard material plate to the substantially conforming surface comprises a flowable adhesive material interposed between the bottom surface of the hard material plate and the substantially conforming surface.

3. The bit of claim 2 wherein the flowable adhesive material is a brazing material.

4. The bit of claim 1 wherein the bottom surface of the hard material plate is attached by the adhesive material to a conforming floor surface formed in or by an outer gage surface of the leg.

5. The bit of claim 4 wherein the conforming floor surface is formed in the outer gage surface of the leg by a slot provided in the outer gage surface, said slot being open at the leading edge and extending inwardly from the leading edge.

6. The bit of claim 1 wherein the bottom surface of the hard material plate is attached by the adhesive material to a conforming floor surface formed in or by a leading surface of the leg.

7. The bit of claim 6 wherein the conforming floor surface is formed in the leading surface of the leg by a slot provided in the leading surface, said slot being open at the leading edge and extending inwardly from the leading edge.

8. The bit of claim 6 wherein the leg includes an outer gage surface and a shoulder surface located above the outer gage surface, the outer gage surface and shoulder surface laterally terminating at the leading edge adjacent the leading surface, and wherein the hard material plate is attached to the conforming floor surface at the leading edge adjacent the shoulder surface.

9. The bit of claim 8 wherein the shoulder surface further includes a pressure compensator opening formed in the shoulder surface, and wherein the hard material plate is attached to the conforming floor surface at the leading edge adjacent the pressure compensator opening formed in the shoulder surface.

10. The bit of claim 6 wherein the leg includes an outer gage surface and a shoulder surface located above the outer gage surface, the outer gage surface and shoulder surface laterally terminating at the leading edge adjacent the leading surface, and wherein the hard material plate is attached to the conforming floor surface at the leading edge adjacent the outer gage surface.

11. The bit of claim 1 wherein the leg includes an outer gage surface and a shoulder surface located above the outer gage surface, and wherein the bottom surface of the hard material plate is attached by the adhesive material to a conforming floor surface formed in or by the shoulder surface of the leg.

12. The bit of claim 11 wherein the conforming floor surface is formed in the shoulder surface of the leg by a slot provided in the shoulder surface, said slot being open at the leading edge and extending inwardly from the leading edge.

13. The bit of claim 11 wherein the shoulder surface further includes a pressure compensator opening formed in the shoulder surface, and wherein the hard material plate is attached to the conforming floor surface at the leading edge adjacent the pressure compensator opening formed in the shoulder surface.

14. The bit of claim 1 wherein the hard material plate is one of: a solid tungsten carbide plate, a polycrystalline diamond compact, an impregnated diamond segment or a polycrystalline cubic boron nitride compact.

15. The bit of claim 1 wherein the hard material plate is not formed of thermally stable polycrystalline diamond.

16. The bit of claim 1 wherein the hard material plate has width w and a thickness t, wherein a ratio $t/w<0.5$.

17. The bit of claim 1 wherein the hard material plate has width w and a thickness t, wherein a ratio $t/w<0.2$.

18. The bit of claim 1 wherein the hard material plate has width w and a thickness t, wherein a ratio $t/w<0.1$.

19. The bit of claim 1 wherein a top surface of the hard material plate is substantially flush with an outer surface of the leg.

20. A rotary cone drill bit, comprising:

a body;

a leg depending from the body, wherein the leg includes a outer gage surface, and includes a shoulder surface above the outer gage surface, and includes a leading surface, wherein the leading surface is adjacent the outer gage and shoulder surfaces at a lateral leading edge of the leg;

a bearing shaft extending from the leg;

a cone mounted to the bearing shaft;

a preformed hard material plate having an edge and a bottom surface; and an adhesive material attaching the bottom surface of the hard material plate to a substantially conforming floor surface formed in or by the leading surface of the leg adjacent the shoulder surface, wherein the edge of the hard material plate defines at least a portion of the lateral leading edge adjacent the shoulder surface.

21. The bit of claim 20 wherein the shoulder surface further includes a pressure compensator opening formed in the shoulder surface, and wherein the hard material plate is attached to the conforming floor surface at the lateral leading edge adjacent the pressure compensator opening formed in the shoulder surface.

22. The bit of claim 20 wherein the adhesive material attaching the bottom surface of the hard material plate to the floor surface of the leg comprises a flowable adhesive material interposed between the bottom surface of the hard material plate and the conforming floor surface of the leg.

23. The bit of claim 22 wherein the flowable adhesive material is a brazing material.

24. The bit of claim 20 wherein the conforming floor surface is formed in the leading surface of the leg by a slot provided in the leading surface, said slot being open at the lateral leading edge and extending inwardly from the lateral leading edge.

25. The bit of claim 20 wherein the hard material plate is one of: a solid tungsten carbide plate, a polycrystalline diamond compact, an impregnated diamond segment or a polycrystalline cubic boron nitride compact.

26. A rotary cone drill bit, comprising:

a body;

a leg depending from the body, wherein the leg includes a outer gage surface, and includes a shoulder surface above the outer gage surface, and includes a leading surface, wherein the leading surface is adjacent the outer gage and shoulder surfaces at a lateral leading edge of the leg;

a bearing shaft extending from the leg;

a cone mounted to the bearing shaft;

a preformed hard material plate having an edge and a bottom surface; and an adhesive material attaching the bottom surface of the hard material plate to a substantially conforming floor surface formed in or by the shoulder surface of the leg, wherein the edge of the hard material plate defines at least a portion of the lateral leading edge.

27. The bit of claim 26 wherein the shoulder surface further includes a pressure compensator opening formed in the shoulder surface, and wherein the hard material plate is attached to the conforming floor surface at the lateral leading edge adjacent the pressure compensator opening formed in the shoulder surface.

28. The bit of claim 26 wherein the adhesive material attaching the bottom surface of the hard material plate to the floor surface of the leg comprises a flowable adhesive material interposed between the bottom surface of the hard material plate and the conforming floor surface of the leg.

29. The bit of claim 26 wherein the flowable adhesive material is a brazing material.

30. The bit of claim 26 wherein the conforming floor surface is formed in the shoulder surface of the leg by a slot provided in the shoulder surface, said slot being open at the lateral leading edge and extending inwardly from the lateral leading edge.

31. The bit of claim 26 wherein the hard material plate is one of: a solid tungsten carbide plate, a polycrystalline diamond compact, an impregnated diamond segment or a polycrystalline cubic boron nitride compact.

* * * * *